US007966732B2

(12) United States Patent
Votolato et al.

(10) Patent No.: US 7,966,732 B2
(45) Date of Patent: Jun. 28, 2011

(54) SAFETY CUTTING APPARATUS

(75) Inventors: Earl Votolato, Newport Beach, CA (US); David A. Sharbaugh, Irvine, CA (US)

(73) Assignee: Spellbound Development Group, Inc., Irvine, CA (US)

( * ) Notice: Subject to any disclaimer, the term of this patent is extended or adjusted under 35 U.S.C. 154(b) by 0 days.

(21) Appl. No.: 12/790,593

(22) Filed: May 28, 2010

(65) Prior Publication Data

US 2010/0236076 A1 Sep. 23, 2010

Related U.S. Application Data

(60) Continuation of application No. 12/582,108, filed on Oct. 20, 2009, now Pat. No. 7,726,029, which is a division of application No. 12/383,677, filed on Mar. 27, 2009, now Pat. No. 7,886,443, which is a continuation of application No. 10/300,382, filed on Nov. 19, 2002, now Pat. No. 7,509,742.

(51) Int. Cl.
*B26B 3/06* (2006.01)
*B26B 29/02* (2006.01)

(52) U.S. Cl. ..... 30/151; 30/286

(58) Field of Classification Search ..... 30/2, 151, 30/161, 162, 288, 286, 294, 320, 329, 340
See application file for complete search history.

(56) References Cited

U.S. PATENT DOCUMENTS

| | | | | |
|---|---|---|---|---|
| 365,714 | A * | 6/1887 | Warner | 30/286 |
| 1,452,893 | A * | 4/1923 | Porth | 30/286 |
| 2,209,751 | A * | 7/1940 | Wulff | 30/2 |
| 2,376,887 | A * | 5/1945 | Walters | 30/151 |
| 2,387,032 | A * | 10/1945 | Lowry | 30/286 |
| 2,730,800 | A * | 1/1956 | Bailey | 30/2 |
| 3,781,988 | A * | 1/1974 | Jones | 30/2 |
| 3,943,627 | A | 3/1976 | Stanley, Jr. | |
| 4,086,698 | A * | 5/1978 | Sparks | 30/2 |
| 4,091,537 | A * | 5/1978 | Stevenson, Jr. | 30/286 |
| 4,319,399 | A | 3/1982 | Ciaffone | |
| 4,757,612 | A | 7/1988 | Peyrot | |
| 4,931,042 | A | 6/1990 | Holmes et al. | |
| 4,980,977 | A | 1/1991 | Matin et al. | |
| 4,987,682 | A * | 1/1991 | Minnick | 30/289 |
| 5,014,429 | A | 5/1991 | McNamara | |
| 5,241,750 | A * | 9/1993 | Chomiak | 30/2 |
| 5,250,064 | A * | 10/1993 | Schneider | 30/151 |
| 5,293,791 | A * | 3/1994 | Allen et al. | 30/90.4 |
| 5,330,494 | A * | 7/1994 | van der Westhuizen et al. | 30/151 |
| 5,502,896 | A | 4/1996 | Chen | |
| 5,522,135 | A * | 6/1996 | Votolato | 30/2 |
| 5,581,893 | A * | 12/1996 | Ouellette | 30/286 |

(Continued)

FOREIGN PATENT DOCUMENTS

| | | |
|---|---|---|
| DE | 3116354 | 11/1982 |

(Continued)

OTHER PUBLICATIONS

Votolato, U.S. Appl. No. 12/383,677 office actions and responses dated between Dec. 4, 2009 to May 21, 2010.

(Continued)

*Primary Examiner* — Jason Daniel Prone
(74) *Attorney, Agent, or Firm* — Robert J. Lauson; Lauson & Tarver LLP

(57) ABSTRACT

A cutting apparatus has a unidirectionally-locking blade cover that automatically snaps back over the exposed blade after each cut, and a dependent, index finger operated unlocking trigger.

19 Claims, 7 Drawing Sheets

U.S. PATENT DOCUMENTS

| | | | | |
|---|---|---|---|---|
| 5,662,669 | A * | 9/1997 | Abidin et al. | 30/151 |
| 5,697,157 | A * | 12/1997 | Votolato | 30/2 |
| 5,843,107 | A * | 12/1998 | Landis et al. | 30/155 |
| 5,852,874 | A * | 12/1998 | Walker | 30/2 |
| 5,870,828 | A * | 2/1999 | Polites | 30/162 |
| 5,878,501 | A * | 3/1999 | Owens et al. | 30/286 |
| 5,890,290 | A * | 4/1999 | Davis | 30/2 |
| 6,070,326 | A | 6/2000 | Berns | |
| 6,178,640 | B1 * | 1/2001 | Votolato | 30/2 |
| 6,233,832 | B1 | 5/2001 | Berns | |
| 6,385,883 | B1 | 5/2002 | Votolato | |
| 6,453,559 | B1 * | 9/2002 | Marshall et al. | 30/2 |
| 6,560,873 | B1 | 5/2003 | Ortner et al. | |
| 6,578,266 | B2 * | 6/2003 | Chomiak | 30/2 |
| 6,643,936 | B2 * | 11/2003 | Carlson et al. | 30/162 |
| 6,658,742 | B2 | 12/2003 | Votolato | |
| 6,713,640 | B2 | 3/2004 | Miller | |
| 6,718,640 | B1 | 4/2004 | John | |
| 6,748,659 | B1 * | 6/2004 | Street | 30/2 |
| 7,082,688 | B2 * | 8/2006 | Votolato | 30/2 |
| 7,356,928 | B2 * | 4/2008 | Votolato | 30/2 |
| 7,475,480 | B2 * | 1/2009 | Votolato | 30/2 |
| 7,509,742 | B2 * | 3/2009 | Votolato | 30/151 |
| 7,726,029 | B2 * | 6/2010 | Votolato | 30/151 |
| 7,766,029 | B2 | 8/2010 | Liepold et al. | |
| 7,886,443 | B2 | 2/2011 | Votolato | |
| 2002/0038512 | A1 | 4/2002 | Votolato | |
| 2002/0124412 | A1 * | 9/2002 | Votolato | 30/200 |
| 2002/0124413 | A1 | 9/2002 | Rutkowski et al. | |
| 2002/0124418 | A1 * | 9/2002 | Votolato | 30/294 |
| 2003/0131393 | A1 | 7/2003 | Votolato | |
| 2004/0035447 | A1 | 2/2004 | Schleeter | |
| 2004/0093734 | A1 | 5/2004 | Votolato | |
| 2005/0086812 | A1 | 4/2005 | Votolato | |
| 2005/0150029 | A1 | 7/2005 | Votolato | |
| 2005/0217114 | A1 | 10/2005 | Votolato | |
| 2006/0005425 | A1 | 1/2006 | Votolato | |
| 2006/0005426 | A1 | 1/2006 | Votolato | |
| 2006/0048389 | A1 | 3/2006 | Votolato | |
| 2007/0068003 | A1 | 3/2007 | Schmidt | |
| 2008/0163493 | A1 * | 7/2008 | Votolato | 30/154 |
| 2009/0172889 | A1 * | 7/2009 | Votolato | 30/337 |
| 2009/0223066 | A1 * | 9/2009 | Votolato | 30/286 |
| 2009/0271988 | A1 * | 11/2009 | Votolato | 30/161 |
| 2009/0313836 | A1 * | 12/2009 | Wei | 30/286 |
| 2010/0275450 | A1 * | 11/2010 | Refson | 30/286 |

FOREIGN PATENT DOCUMENTS

| | | | |
|---|---|---|---|
| DE | 3400850 | | 7/1985 |
| DE | 3400850 | A1 * | 7/1985 |
| DE | 3116354 | C2 * | 1/1987 |
| DE | G8912929.6 | | 2/1990 |
| DE | G 8912929.6 | * | 2/1990 |
| DE | 26 23 490 | | 10/1997 |
| EP | 0 395 338 | | 10/1990 |
| EP | 0 963 819 | | 12/1999 |
| EP | 1 422 031 | | 5/2004 |
| EP | 1422031 | A1 * | 5/2004 |
| FR | 2 572 984 | | 5/1986 |
| GB | 1 523 168 | | 8/1978 |
| GB | 1 547 002 | | 6/1979 |
| GB | 2 050 227 | | 1/1981 |
| GB | 2 085 790 | | 5/1982 |
| GB | 2 232 371 | | 12/1990 |
| WO | WO 94/04324 | | 3/1994 |
| WO | WO 9404324 | A1 * | 3/1994 |
| WO | PCT GB00 01493 | | 11/2000 |

OTHER PUBLICATIONS

Votolato, inter partes reexam. U.S. Appl. No. 95/001,439 office actions and responses dated between Nov. 18, 2010 to Feb. 18, 2011.
U.S. Appl. No. 95/001,439; Office Action; Nov. 18, 2010; pp. 3-8.
U.S. Appl. No. 95/001,439; Amendment/Response; Jan. 18, 2011; pp. 4-15.
U.S. Appl. No. 95/001,439; Petitioner Response; Feb. 18, 2011; pp. 1-19.
U.S. Appl. No. 95/001,441; Office Action; Nov. 18, 2010; pp. 3-9.
U.S. Appl. No. 95/001,441; Amendment/Response; Jan. 18, 2011; pp. 4-16.
U.S. Appl. No. 95/001,441; Petitioner Response; Feb. 18, 2011; pp. 1-9.
U.S. Appl. No. 95/001,441; Office Action Closing Prosecution; Mar. 8, 2011.
U.S. Appl. No. 95/001,442; Office Action; Nov. 8, 2010; pp. 6-23.
U.S. Appl. No. 95/001,442; Amendment/Response; Jan. 10, 2011; pp. 5-14.
U.S. Appl. No. 95/001,442; Office Action Closing Prosecution; Mar. 3, 2011.
U.S. Appl. No. 95/001,442; Amendment/Response; Apr. 4, 2011; pp. 4-6.
U.S. Appl. No. 10/936,891; Office Action; Mar. 6, 2007; pp. 4-8.
U.S. Appl. No. 10/936,891; Response to Office Action; Jun. 5, 2007; p. 5.
U.S. Appl. No. 10/936,891; Office Action; Oct. 17, 2007; p. 4.
U.S. Appl. No. 10/936,891; Response to Office Action Nov. 6, 2007; p. 5.
U.S. Appl. No. 10/031,249; Office Action; Jun. 26, 2003; p. 2.
U.S. Appl. No. 10/031,249; Amendment/Response; Oct. 17, 2003; pp. 9-12.
Memorandum of points and Authorities in Support of Motion for Summary Judgment of Non-Infringement and Invalidity; Patent No. 6,718,640; Dec. 20, 2010.
Opposition to the Motion for Summary Judgment and Declarations of Earl J. Votolato and Dr. J. Michael McCarthy in support thereof; 6,718,640; Jan. 18, 2011.
Declaration of Dr. J. Michael McCarthy in Support of Opposition to the Summary Judgment Motion; 6,718,640; Jan. 18, 2011.
Opposition to the Motion for Summary Judgment and Declarations of Earl J. Votolato and Dr. J. Michael McCarthy in Support Thereof; 7,726,029; Jan. 18, 2011.
Declaration of Dr. J. Michael McCarthy in Support of Opposition to the Summary Judgment Motion; 7,726,029; Jan. 18, 2011.
Opposition to the Motion for Summary Judgment and Declarations of Earl J. Votolato and Dr. J. Michael McCarthy in Support Thereof; 7,356,928.
Declaration of Dr. J. Michael McCarthy in Support of Opposition to the Summary Judgment Motion: 7,356,928; Jan. 18, 2011.
Defendants' Reply in Further Support of Motion for Summary Judgment of Non-Infringement and Invalidity; 6,718,640.
Defendants' Supplemental Responses to Plaintiff's First Set of Interrogatories; Jul. 16, 2010; pp. 4-8.
Defendants' Answers to Plaintiff's Second Set of Interrogatories; Nov. 10, 2010; pp. 10-11.
Defendants' Answers to Plaintiff's Third Set of Interrogatories; Dec. 23, 2010; pp. 3-10.
Defendants' Supplemental Answers to Plaintiff's First Set of Interrogatories; Jan. 5, 2011; pp. 9-53.
Plaintiff's Points and Authorities Memorandum Supporting Motion for Preliminary Injunction; [Claim Charts re '928]; Jul. 19, 2010; pp. 3-19.
Plaintiff's Points and Authorities Memorandum Supporting Motion for Preliminary Injunction; [Claim Charts re '640]; Jul. 19, 2010/ pp. 3-19.
Plaintiff's Points and Authorities Memorandum Supporting Motion for Preliminary Injunction; [Claim Charts re '029]; Jul. 19, 2010; pp. 3-19.
Plaintiff's Reply to Petitioner's Opposition to Plaintiff's Motion for Preliminary Injunction; Aug. 19, 2010; pp. 1-17.
Order Denying Preliminary Injunction; Sep. 8, 2010; pp. 2-13.
Rebuttal Expert Report of Professor Steven C. Visser; Feb. 14, 2011.
Supplemental Report of Dr. J. Michael McCarthy; Jan. 30, 2011.
Report of Dr. J. Michael McCarthy; Jan. 10, 2011.
Supplemental Expert Report of Professor Steven C. Visser; Dec. 29, 2010.
Expert Report of Professor Steven C. Visser; Dec. 7, 2010.
Expert Witness Report of Frank L. Landon; Nov. 15, 2010.
Deposition of John M. McCarthy, Ph.D.; Feb. 9, 2011.

* cited by examiner

SAFETY CUTTING APPARATUS

CROSS-REFERENCE TO RELATED APPLICATIONS

This application is a continuation of U.S. patent application having Ser. No. 12/582,108 filed Oct. 20, 2009 now U.S. Pat. No. 7,726,029, which is a divisional of U.S. patent application having Ser. No. 12/383,677 filed on Mar. 27, 2009 now U.S. Pat. No. 7,886,443, which is continuation of U.S. patent application having Ser. No. 10/300,382 filed on Nov. 19, 2002, now issued U.S. Pat. No. 7,509,742 on Mar. 31, 2009. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is cutting devices and apparatus, knives and utility knives.

BACKGROUND OF THE SUBJECT MATTER

Industries that utilize cutting devices and apparatus in everyday and/or routine activities, such as opening boxes and bags, cutting and sizing cardboard, rope, heavy paper, fabric, plastic bags and the like and any other activity or task that requires the use of a cutting device or apparatus requires or mandates that the cutting device or apparatus meet certain minimum safety criteria, and ultimately, wants a cutting device or apparatus that maximizes safety features for the operator, while allowing the operator to easily perform the desired tasks with the cutting device or apparatus.

There are many reasons that industries want safer cutting devices and safer conditions for employees, including a) minimizes workplace accidents, b) minimizes lost time on the job of employees, c) acts as a possible marketing tool for the employer to potential employees, d) reduces risk from an insurance standpoint and could contribute to lower insurance premiums or additional coverage and e) reduces liability-based legal actions and arbitrations.

There have been many attempts to manufacture a safer utility knife or cutting device. U.S. Pat. No. 5,878,501 issued to Owens et al. on Mar. 9, 1999 describes one such attempt to create a safer utility knife. The Owens utility knife comprises a blade cover that shields the operator from an exposed blade edge when the utility knife is not in use. The operator exposes the cutting surface of the blade by depressing two buttons on the side of the utility knife that are connected to the blade cover. Once the buttons are depressed, they can be pulled back away from the blade, thus pulling back the blade cover and exposing the cutting surface of the blade. However, once the cutting surface of the blade is exposed, only a conscious movement by the operator of depressing the buttons and pulling them towards the cutting surface can pull the blade cover over the cutting surface of the blade protecting the operator from further exposure to the cutting surface.

In U.S. patent application Ser. No. 09/804,451 filed on Mar. 12, 2001, which is commonly assigned and is incorporated herein by reference in its entirety, Votoloto improved on the Owens utility knife by providing a blade cover that can be pulled back from the cutting surface of the blade by using a trigger lever. If the trigger lever is depressed too quickly, such as what might occur in a panic situation, an intercept member causes disengagement of the blade cover from the trigger lever, thus causing the blade cover to return to a position where the cutting surface of the blade is covered by the blade cover. While the Votolato utility knife is an advancement in safety for utility knives and cutting tools, there are still aspects of that knife that could be improved. For example, there is no automatic function that closes the blade cover over the cutting surface in non-panic-type of situations, such as completion of a cutting job.

In addition to safety requirements, companies that utilize cutting devices and apparatus also would like to see certain ergonomic, sanitary and aesthetic features incorporated into the cutting device or apparatus, as mentioned previously herein. With respect to the sanitary requirement, industries that rely on the cutting device to be sanitary are the food service, food preparation and food sales industries, along with any other industries or companies where utility knives could contact food or food preparation surfaces. Another requirement or focus would be to eliminate loose razor blade contamination of food, food stuff, food preparation areas, food processing batches, pharmaceutical batches, chemical batches and other products that are easily contaminated by loose razor blades and razor blade pieces.

Therefore, there is a need for a cutting device or apparatus that a) is safe to use by the operator, b) reduces workplace accidents and the risk of workplace accidents, c) is ergonomically safe and effective, d) is sanitary for use around and in preparing consumer products, e) is aesthetically pleasing in an environment, such that it will be regularly used, and f) eliminates or greatly minimizes contamination of consumer products by loose blades and loose blade pieces.

SUMMARY OF THE INVENTION

A cutting apparatus has been produced that eliminates the common occurrence of raw razor blades contaminating everything from food and food products to garbage cans to shelves in retail stores. Furthermore, the cutting apparatus comprises a guard assembly that, when activated, opens the blade cover and allows only one cut to be made with the exposed blade before the unidirectionally-locking blade cover snaps back over the exposed blade and locks into a closed position, thus preventing laceration-related accidents. In addition, if the operator continues to activate the guard assembly (squeezing, pulling and/or depressing the trigger and/or releasing the trigger and continuing to hold it in the released position during and after the cut has been made) after one cut has been made with the exposed blade, the unidirectionally-locking blade cover will still snap back over the exposed blade, despite the position of the trigger. Once the blade cover snaps back over the exposed blade and locks into the closed position, the locking device is activated and acts to hold the blade cover securely over the blade until the blade assembly is further activated by releasing the trigger from the depressed position and depressing or pulling the trigger once again.

As described herein, a cutting apparatus comprises a) a handle assembly; b) a guard assembly coupled to the handle assembly, wherein the guard assembly comprises a unidirectionally-locking blade cover, a trigger and a locking device; and c) a removable blade assembly coupled to the handle assembly, wherein the blade assembly comprises a blade guard, a blade and a holder apparatus.

Also as described herein, a method of using a safety cutting apparatus comprises a) providing a surface; b) providing the safety cutting apparatus described herein; c) releasing the trigger; d) applying the blade to the surface; and e) cutting the surface, wherein cutting comprises making only one continuous cut in the surface.

DETAILED DESCRIPTION

A cutting apparatus has been produced that eliminates the common occurrence of raw razor blades contaminating everything from food and food products to garbage cans to shelves in retail stores. Furthermore, the cutting apparatus comprises a guard assembly that, when activated, opens the blade cover and allows only one cut to be made with the exposed blade before the unidirectionally-locking blade cover snaps back over the exposed blade and locks into place, thus preventing laceration-related accidents. In addition, if the operator continues to activate the guard assembly after one cut has been made with the exposed blade, the unidirectionally-locking blade cover will still snap back and lock into place over the exposed blade, despite the position of the trigger. As used herein, the phrase "if the operator continues to activate" means that if the operator is releasing, squeezing, depressing and/or pulling the trigger or releasing the trigger and continuing to hold it in the released position during and after the cut has been made, the unidirectionally-locking blade cover will still snap back and lock into place over the exposed blade, despite the position of the trigger. Once the blade cover snaps back over the exposed blade, the locking device is activated and acts to hold the blade cover securely over the blade until the blade assembly is further activated by releasing the trigger from the depressed position and depressing, releasing, squeezing or pulling the trigger once again.

Figure 1A:
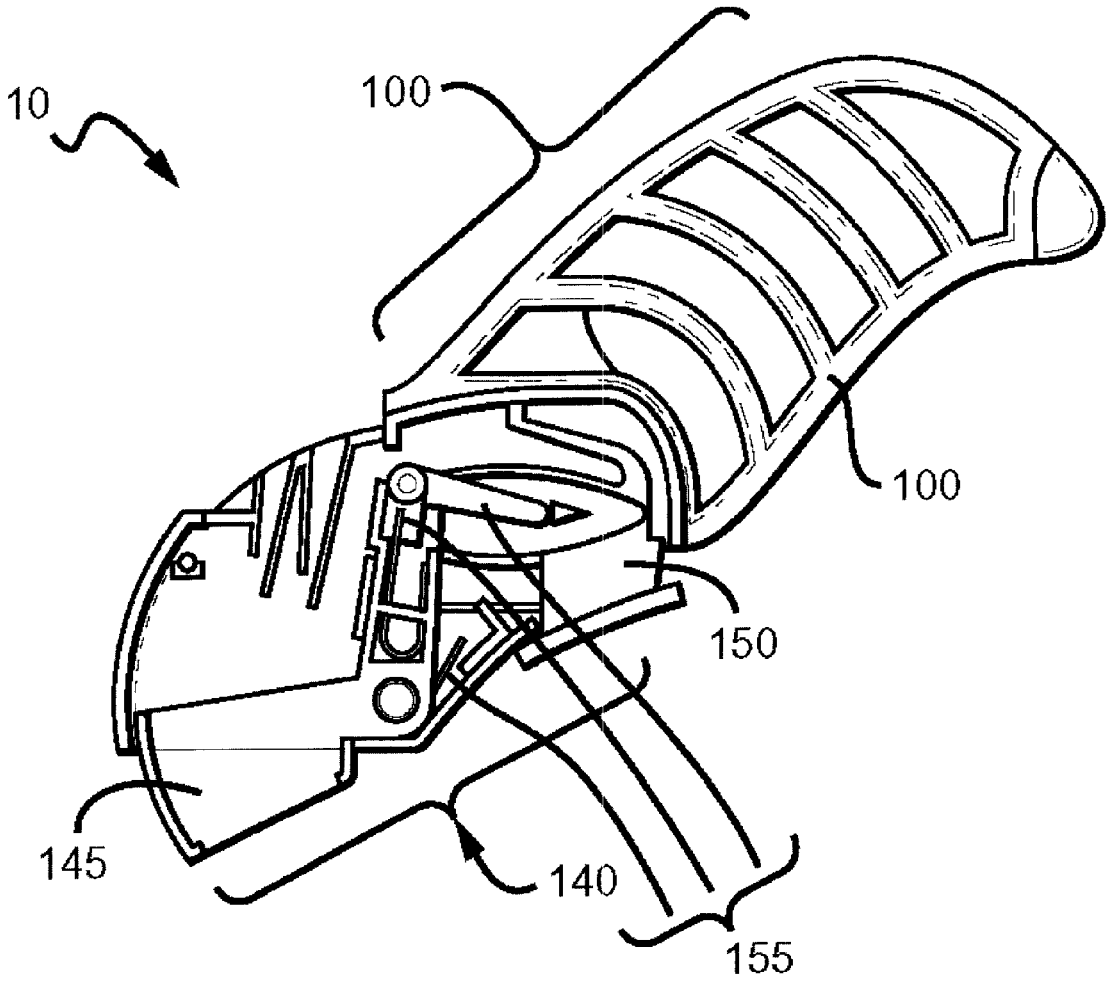
FIG. 1A-1B are contemplated embodiments of the safety cutting apparatus.
Figure 1B:
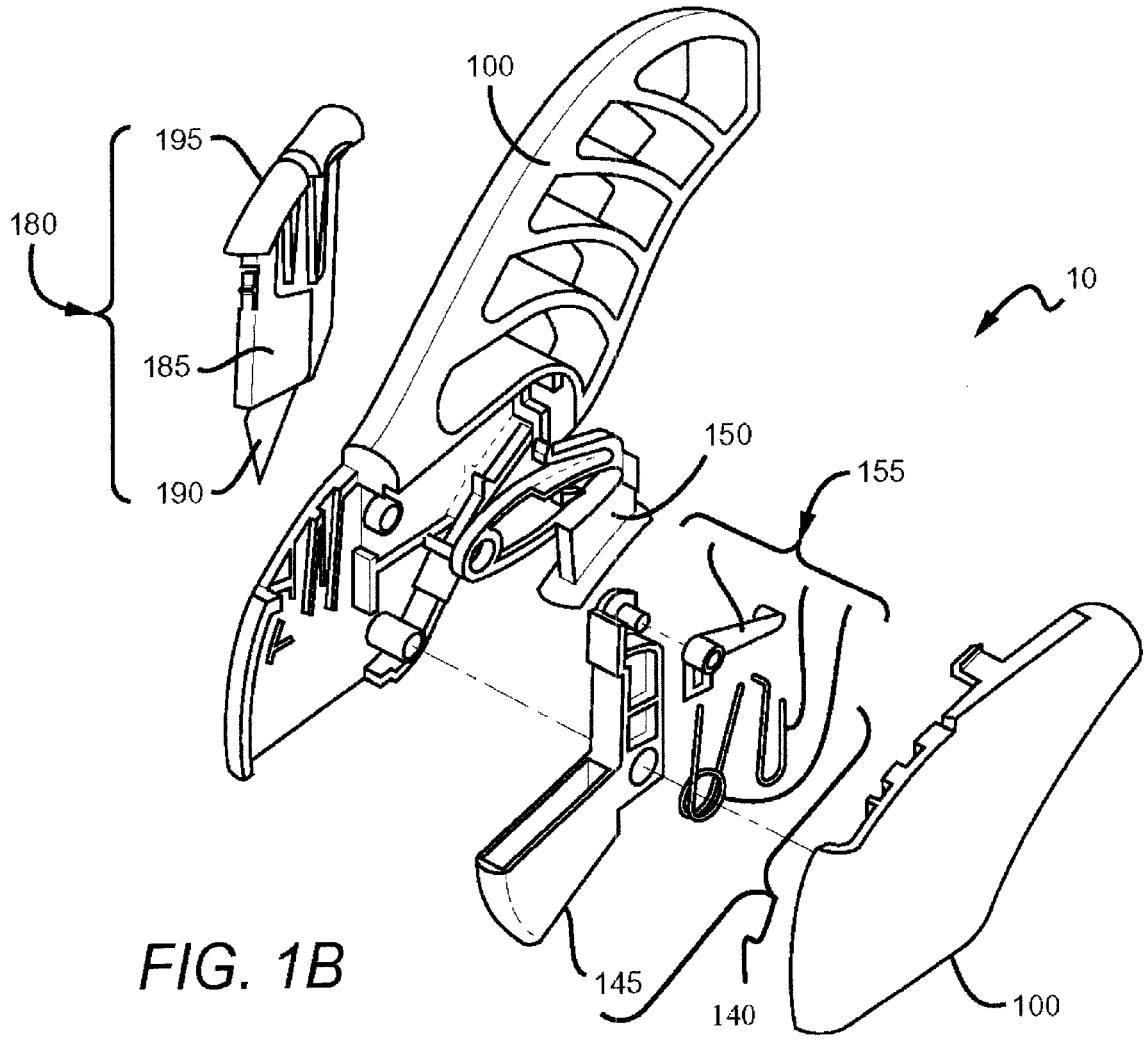

As described herein, a contemplated cutting apparatus 10 is shown in FIG. 1A-1B and comprises a) a handle assembly 100; b) a guard assembly 140 coupled to the handle assembly 100, wherein the guard assembly 140 comprises a unidirectionally-locking blade cover 145, a trigger 150 and a locking device 155; and c) a removable blade assembly 180 coupled to the handle assembly 100, wherein the blade assembly 180 comprises a blade guard 185, a blade 190 and a holder apparatus 195.

Figure 2:
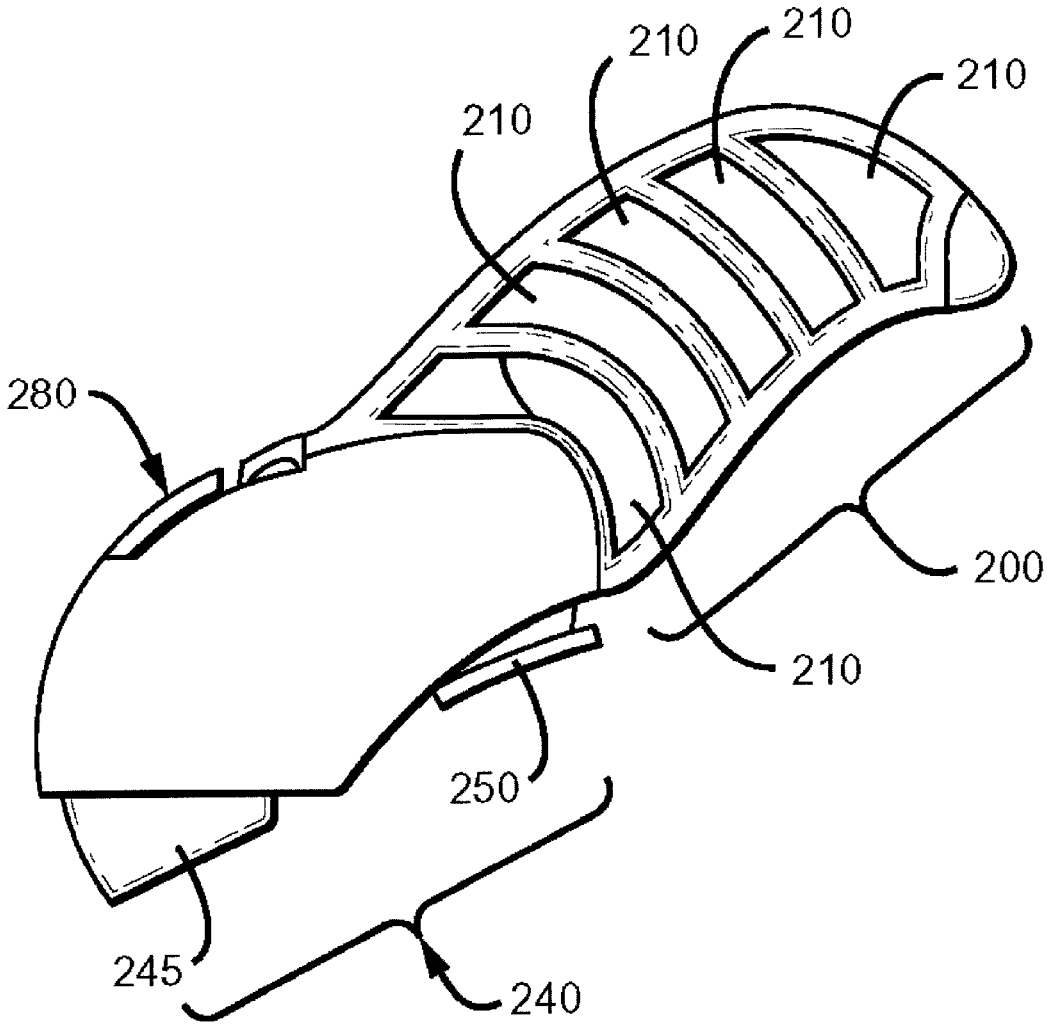
FIG. 2 shows a contemplated embodiment of the safety cutting apparatus.

The handle assembly 200 of the cutting apparatus, as shown in FIG. 2, is designed to a) comfortably and ergonomically fit the hand of the operator for ease of use, b) couple with the blade assembly 280 and c) couple with the guard assembly 240, where the blade cover 245 and trigger 250 are shown. The handle assembly 200 can be designed as shown to have venting openings 210 or "pass-throughs" throughout the handle allowing for the hand holding it to "breath", thus resulting in a cooling effect on the hand holding it. The vents 210 in the handle assembly 200 also contribute to the light weight of the knife. In other contemplated embodiments, the handle assembly 200 may comprise a solid handle—i.e. without vents 210 or pass-throughs. In this case, a removable gripper cover (not shown) comprising a breathable material may cover the handle. For example, the breathable material may comprise holes or pores that allow the material to stay dry during long periods of use. Furthermore, the gripper cover can be removable and either disposable or washable, so that the handle stays clean during use by several operators over a period of time or during prolonged use by one user. In these embodiments, the removable gripper cover would slip onto the distal end of the handle assembly away from the blade assembly and cover the portion of the handle assembly up to the trigger and trigger opening.

Figure 3A:
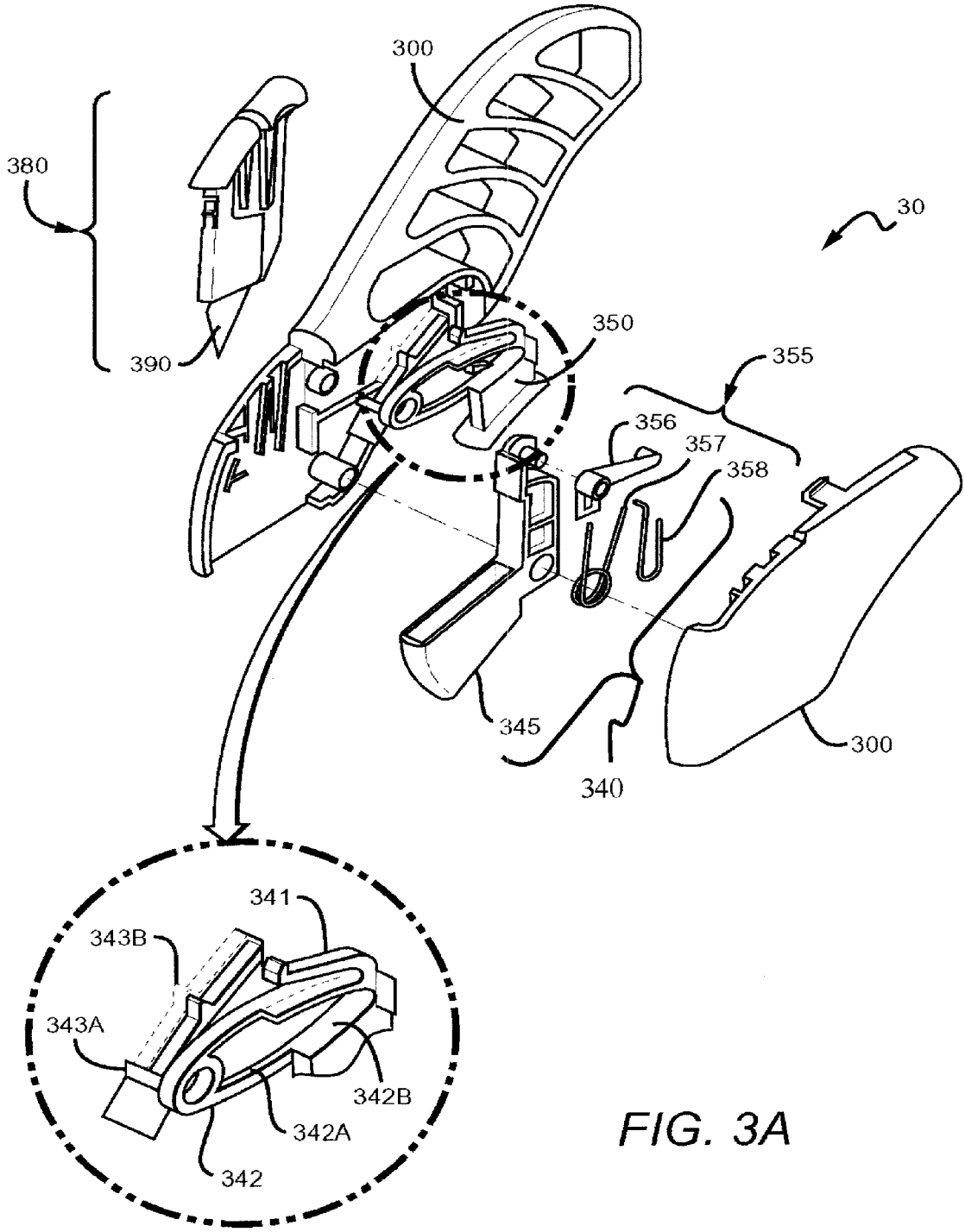
FIG. 3A-3C shows contemplated embodiments of the safety cutting apparatus.
Figure 3B:
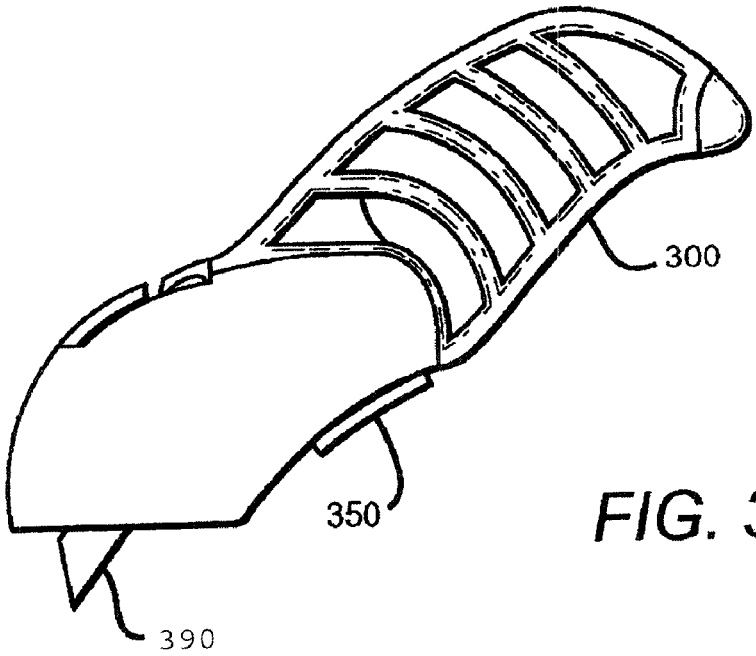
Figure 3C:
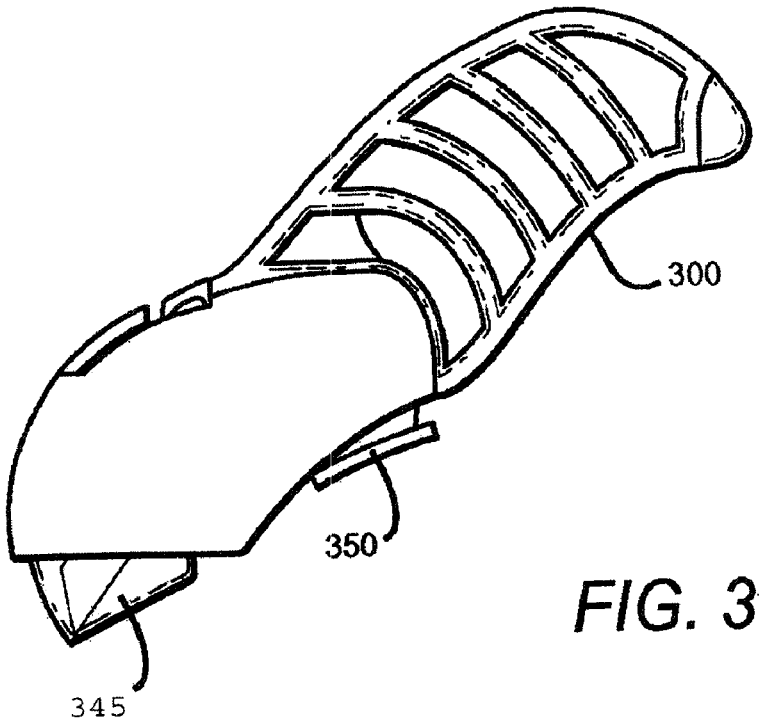

Also, as contemplated and as shown in FIGS. 3A-3C, the cutting apparatus 30 comprises a guard assembly 340 coupled to the handle assembly 300, wherein the guard assembly 340 comprises a unidirectionally-locking blade cover 345, a trigger 350 and a locking device 355 which comprises a pawl 356. In some contemplated embodiments, the blade assembly 380 is covered by a movable, spring-loaded unidirectionally-locking blade cover 345. A locking device 355 contained within the handle assembly 300 locks the blade cover 345 over the blade 390. As mentioned, releasing by squeezing, pulling and/or depressing a trigger 350 on the exterior of the handle assembly 300 unlocks the blade cover 345 and allows only one cut to be made in a material or on a surface (not shown). This safety feature is activated by a) releasing—squeezing, pulling and/or depressing—the trigger 350 on the exterior of the handle assembly 300, thus deactivating the locking device 355; b) pressing the unidirectionally-locking blade cover 345 against a surface in order to make a cut into a surface or material; and c) exposing the blade 390 by rotating the blade cover 345 back into the handle assembly 300. The exposed is shown in FIG. 3B. Once the cut is made and the operator pulls the blade 390 out of the material or surface, pressure is removed from the blade cover 345 and the blade cover 345 rotates back over the blade 390 and locks. The locked blade cover 345 over the blade 390 is shown in FIG. 3C. In order to make another cut, the trigger 350 must be released—depressed, pulled and/or squeezed again. Therefore, as used herein, the "unidirectionally-locking" blade cover 345 is defined, in that the blade cover 345 only locks in place in one direction, and that direction is when the blade cover 345 is covering the blade 390. When the blade cover 345 is unlocked and the blade 390 is exposed, the blade cover 345 is not locked into place exposing the blade 390, but is instead held into an open position (exposing the blade 390) by the pressure exerted on the blade cover 345 by the surface or material being cut.

As mentioned and as shown in FIG. 3A, the guard assembly 340 comprises three active parts—the trigger 350, a locking device 355 which comprises a pawl 356, and the blade cover 345. In one contemplated embodiment, two springs and/or spring-like devices, one spring 357 for the blade cover and one spring 358 for the pawl, activate these parts (a "spring and pawl assembly"). The trigger 350 is activated via its own integral, molded spring arm 342, which includes components 341, 342A and 342B. The handle assembly 300 provides the pivots and stops 343A, 343B necessary for mounting and limiting the travel of the active parts and springs. The blade cover 345 and the trigger 350 pivot on the handle assembly 300; the pawl 356 and its spring 358 pivot on the blade cover 345. The pawl 356 links rotary motion from the blade cover 345 to the trigger 350. The configuration and material of the pawl 356 allow it to flex sideways and spring back even though it is rigid in all other directions. A portion of the pawl 356 rides in a looped pathway on the trigger 350. Two ramped steps on the pathway limit the pawl's 356 travel to one direction. This forces it, once it starts along the pathway, to finish a complete loop. This one-direction travel is what allows locking of the blade cover 345 to be accomplished independent of the trigger position.

Normally, the trigger 350 rests where the pawl 356 cannot enter the pathway. Because the pawl 356 cannot enter the pathway, or move anywhere else within the handle assembly 300, the blade cover 345 cannot move from covering the blade 390. Releasing the trigger 350 positions the pathway where the pawl 356 can enter it, which allows the blade cover 345 to rotate, thus exposing the blade 390 when pressure is exerted on the blade cover 345 from the surface and/or material to be cut (not shown). If the trigger 350 is released at this point, before the blade cover 345 is moved at all, the blade cover 345 relocks. If however, the blade cover 345 is pressed against a surface and/or material to make a cut, the blade cover 345 is rotated into the handle assembly 300 exposing the blade 390. As the blade cover 345 rotates, it moves the pawl 356 and causes the pawl 356 to travel along the pathway. As it does, it flexes laterally to ride up and over the ramped steps, and springs back once past the ramped steps.

After the pawl 356 travels over the first step, it cannot retrace its path and enters the return segment of the pathway. Now, when pressure is taken off the blade cover 345, its return spring rotates it back over the blade 390. This rotation causes the pawl 356 to continue over a second step. If the trigger 350 has already been released, the pawl 356 simply returns to the locked starting position. However, if the trigger 350 has not been released, the pawl 356 could return to the unlocked starting position. To prevent this, the pathway is configured to hold the pawl 356 against the second step, which also keeps it from retracing its path. As a result, the blade cover 345 is locked, and remains so until the trigger 350 is completely released and squeezed again.

Figure 4A:
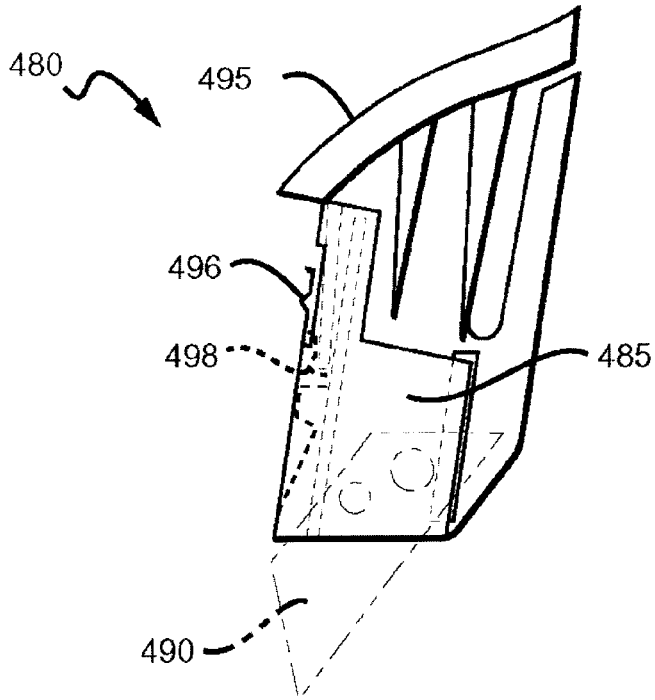
FIG. 4A-4B shows contemplated embodiments of the blade assembly.

The blade assembly 480 is shown in FIG. 4A and is completely removable from the handle assembly (not shown) and comprises a blade guard 485, a blade 490 and a holder apparatus 495. Furthermore, the blade assembly 480 is designed to hold only one blade 490 at a time. The blade 490 is fixedly coupled to the holder apparatus 495, and therefore, moves only when the holder apparatus 495 moves. The blade assembly 480 is disposable in relation to the cutting apparatus (not shown) and is safe to handle by the operator prior to coupling to, during coupling to and upon removal from the handle assembly (not shown). The blade guard 485 is designed to effectively cover and lock over either the cutting surface of or the entire blade 490 until the blade assembly 480 is coupled to the handle assembly (not shown). As the blade assembly 480 is being coupled to the handle assembly, the blade guard 485 retracts from covering the cutting surface of or the entire blade 490 and locks into place by coupling with a latch 496 The latch 496 holds the blade guard 485 in place and away from the cutting surface of the blade 490 until the blade assembly 480 is removed from the handle assembly. The blade guard 485 effectively eliminates all the injuries and contamination-related issues caused from raw blade handling and also from someone reaching down into a trash receptacle and getting cut by an exposed blade. And as mentioned earlier, the herein-described blade assembly and ultimately the cutting apparatus eliminates loose razor blade contamination of food, food stuff, food preparation areas, food processing batches, pharmaceutical batches, chemical batches and other products that are easily contaminated by loose razor blades and razor blade pieces.

Figure 4B:
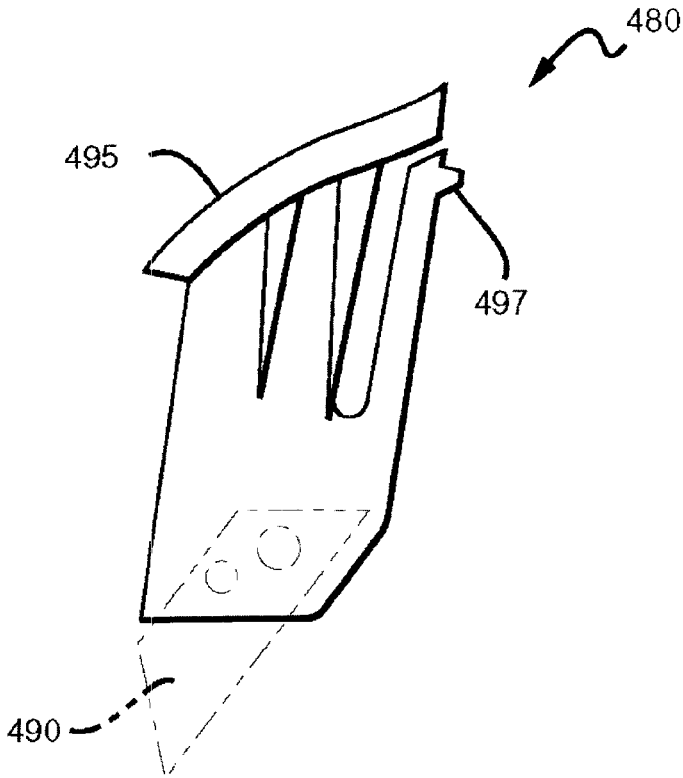

In some embodiments, and as shown in FIG. 4B, however, the blade assembly 480 is not removable from the handle assembly (not shown), but is instead fixed into the handle assembly, such that when the blade life expires and/or the blade 490 dulls, the entire cutting apparatus (not shown) can be disposed of by the operator. In these embodiments, the entire cutting apparatus becomes the blade assembly—meaning that the entire cutting apparatus is removable and disposable. In those embodiments where the blade assembly 480 is not removable from the handle assembly, there will not be a blade guard 485 coupled to the blade assembly 480, since there is no assembly step or removal step of the blade assembly to and from the handle assembly.

As an example of one contemplated embodiment and as shown in FIGS. 4A and 4B, the holder apparatus 495 of the blade assembly 480 provides spring snaps that 1) latch (latch 496) the blade guard 485 over the blade 490 when the blade assembly 480 is out of the handle assembly (not shown), and 2) latch (latch 497) the blade assembly 480 into the handle assembly. The blade guard 485 incorporates an additional latch 498 that latches the shield into the handle assembly independent of the latch 497 for the handle assembly. This additional latch 498 is to insure, as described below, that the blade guard 485 recovers the blade 490 as the blade assembly 480 is being removed from the handle assembly. A stop tab on the blade guard 485 travels in a track on the holder apparatus 495 of the blade assembly 480 and prevents the blade guard 485 from being pulled off of or detached from the blade assembly 480 in part or altogether.

When the blade assembly 480 is first inserted into the handle assembly, the blade assembly 480 travels freely until stops on the blade guard 485 hit the handle assembly and latch 498 engages. As more pressure is applied to the blade assembly 480, latch 496 is over-ridden and the holder apparatus 495 of the blade assembly 480 continues to slide into the handle assembly uncovering the blade 490 as it does. When the blade assembly 480 reaches the limit of its travel, latch 497 engages locking the blade assembly 480 into the handle assembly.

To remove the blade assembly 480, the user operates latch 497 and pulls the holder apparatus 495 of the blade assembly 480 out of the handle assembly (not shown). Because the blade guard 485 is still latched by latch 496, the holder apparatus 495 moves independent of the blade guard 485, recovering the blade 490. When the stop tab reaches the end of its travel, latch 496 re-latches and latch 498 is over-ridden allowing the entire blade assembly 480, with the blade 490 now recovered by the blade guard 485, to be pulled free of the handle assembly.

Figure 5A:
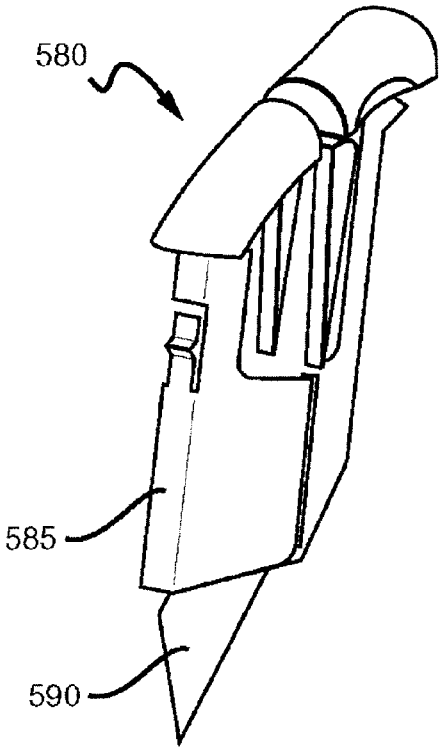
FIG. 5A-5B shows contemplated embodiments of the blade assembly.
Figure 5B:
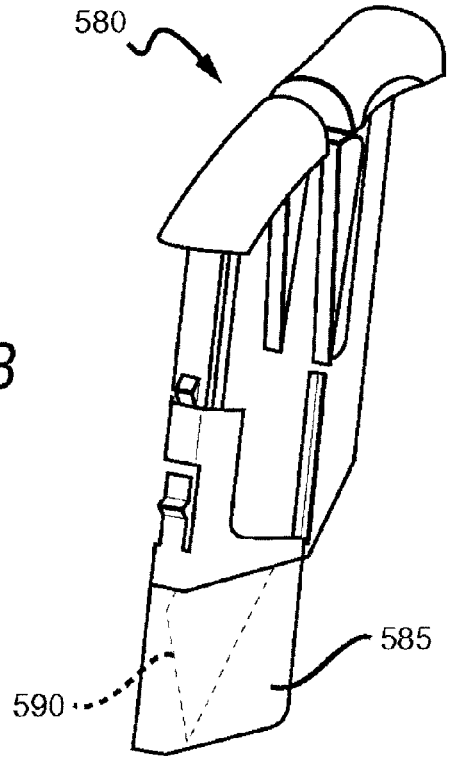

FIGS. 5A and 5B show another contemplated blade assembly 580 where in FIG. 5A the blade guard 585 is locked in the open position exposing the blade 590 and in FIG. 5B the blade guard 585 is covering the blade 590 in the closed position. In FIG. 5B the blade 590 is shown as dotted lines to indicate that its covered by the blade guard 585. In contemplated embodiments, the blade assembly will, in part or in total, be a bright florescent color to aid in finding them should the assembly be left on shelves or fall into product. In other embodiments, the blade assembly may be suitably marked with any color that will make the assembly readily visible to the naked eye when the assembly is on a shelf, in a consumer product or in a trash can. This prominent color marking or treatment results in the drastic reduction and/or elimination of the blade assemblies contaminating food, retail shelves, and other products. Prominent color marking and/or color treatment will also result in fewer injuries to consumers and the high legal and medical costs associated with those injuries.

In some contemplated embodiments, the blade may be set into the blade cartridge such that the blade is exposed at differing potential cutting depths. For example, in some instances, the blade may be exposed only a few millimeters, in order to cut thin surfaces. In other instances, the blade may be exposed at least a centimeter or more in order to cut corrugated cardboard surfaces or other thick surfaces. In these instances, the color coding of the blade cartridge may be set such that different colors indicate different blade cutting depths. For example, fluorescent green may indicate a cutting depth of 4 mm, while cherry red indicates a cutting depth of 1 cm, and so forth. In other instances, the number of stripes or dots on the blade cartridge may indicate cutting depth of the blade. For example, a fluorescent green blade cartridge with 4 bright orange dots may mean a cutting depth of 4 mm (1 mm corresponding for each dot, 1 stripe every 1 cm), while a cherry red blade cartridge with one bright yellow stripe means 1 cm cutting depth. This stripe and dot color coding will help those who are color blind or who otherwise have trouble distinguishing one color.

In a contemplated embodiment, the blade comprises metal while the remaining components of the cutting apparatus comprise an organic or inorganic-based material, such as a particular kind of plastic, composite material or other suitable material. However, it is contemplated that every component of the cutting apparatus may comprise metal, a metal-based material, an organic-based material, an inorganic-based material, an organometallic-based material, a composite material and/or a combination thereof. Materials contemplated herein may further comprise polymers and/or monomers. It is contemplated that suitable materials are those materials that can be used to form a cutting apparatus capable of cutting or slicing into a layer or layers of matter, such as paper, cardboard, plastic, metal sheeting, wood, glass, drywall and the like.

As used herein, the term "metal" means those elements that are in the d-block and f-block of the Periodic Chart of the Elements, along with those elements that have metal-like properties, such as silicon and germanium. As used herein, the phrase "d-block" means those elements that have electrons filling the 3d, 4d, 5d, and 6d orbitals surrounding the nucleus of the element. As used herein, the phrase "f-block" means those elements that have electrons filling the 4f and 5f orbitals surrounding the nucleus of the element, including the lanthanides and the actinides. Preferred metals include titanium, silicon, cobalt, copper, nickel, zinc, vanadium, aluminum, chromium, platinum, gold, silver, steel and stainless steel. More preferred metals include titanium, silicon, copper, aluminum, nickel, platinum, gold, silver and tungsten. Most preferred metals include titanium, aluminum, silicon, copper and nickel. The term "metal" also includes alloys, metal/metal composites, metal ceramic composites, metal polymer composites, as well as other metal composites.

As used herein, the term "monomer" refers to any chemical compound that is capable of forming a covalent bond with itself or a chemically different compound in a repetitive manner. The repetitive bond formation between monomers may lead to a linear, branched, super-branched, or three-dimensional product. Furthermore, monomers may themselves comprise repetitive building blocks, and when polymerized the polymers formed from such monomers are then termed "blockpolymers". Monomers may belong to various chemical classes of molecules including organic, organometallic or inorganic molecules. The molecular weight of monomers may vary greatly between about 40 Dalton and 20000 Dalton. However, especially when monomers comprise repetitive building blocks, monomers may have even higher molecular weights. Monomers may also include additional groups, such as groups used for crosslinking.

As used herein, the term "crosslinking" refers to a process in which at least two molecules, or two portions of a long molecule, are joined together by a chemical interaction. Such interactions may occur in many different ways including formation of a covalent bond, formation of hydrogen bonds, hydrophobic, hydrophilic, ionic or electrostatic interaction. Furthermore, molecular interaction may also be characterized by an at least temporary physical connection between a molecule and itself or between two or more molecules.

Contemplated polymers may also comprise a wide range of functional or structural moieties, including aromatic systems, and halogenated groups. Furthermore, appropriate polymers may have many configurations, including a homopolymer, and a heteropolymer. Moreover, alternative polymers may have various forms, such as linear, branched, super-branched, or three-dimensional.

There are several benefits and advantages to using the cutting apparatus described herein, including but not limited to:

inexpensive to manufacture due to minimal use of material and parts built in safety mechanisms that allow for one single cut or slice into a material eliminates loose razor blades and associated medical, insurance, financial and time losses because of razor blade-related accidents minimizes many of the lacerations associated with the knives and cutting devices on the market today, especially the lacerations that result from the cutting device slipping off of the surface and into the operator's leg, arm, abdomen, etc.

ergonomically sound in that the cutting apparatus is lightweight and easy to handle based on design modifications In some additional embodiments of the cutting apparatus, the apparatus comprises a tape piercing member that is located on the distal end of the handle assembly. The tape piercing member is designed to break or pierce tape found holding box flaps or other surface areas closed on most boxed items or otherwise contained items. This tape piercing member is a safe and easy way to cut open a box without having to use the blade. The tape piercing member is also used to eliminate the damage to the contents of the box or container caused by a blade opening the box or container with the contents being cut by the blade.

Thus, several specific embodiments and applications of the cutting apparatus have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A cutting apparatus comprising:

a handle;

a blade coupled with the handle;

a blade cover configured to rotate between a locked safety position covering the blade and an unlocked operating position where the blade can be uncovered;

a pawl continuously coupled to the blade cover, the pawl configured to engage a stop when the blade cover is in the locked safety position;

a trigger coupled to the handle and configured, upon actuation, to disengage the pawl from the stop allowing movement of the blade cover to uncover the blade; and the trigger comprising a trigger pathway in which at least a portion of the pawl travels as the blade cover covers or uncovers the blade, the trigger pathway configured to allow the pawl to return to a locked position when the trigger has not been released;

wherein the pawl remains in the trigger pathway when the blade is uncovered.

2. The apparatus of claim 1, wherein the travel of the at least a portion of the pawl along the trigger pathway allows locking the blade cover independently of the trigger position after actuation.

3. The apparatus of claim 1, wherein the blade cover is pivotally coupled to the handle.

4. The apparatus of claim 3, wherein rotation of the blade cover cause the travel of the at least a portion of the pawl along the trigger pathway.

5. The apparatus of claim 1, wherein the trigger pathway comprises a looped trigger pathway.

6. The apparatus of claim 1, wherein the pawl is rigid in at least one direction, such that the blade cover is maintained in the locked safety position when the pawl is engaging the stop.

7. The apparatus of claim 1, wherein the trigger comprises the stop.

8. The apparatus of claim 7, wherein upon actuation, the trigger moves the stop relative to the pawl to disengage the pawl and stop.

9. The apparatus of claim 1, further comprising a return spring coupled to the blade cover and configured to return the blade cover back over the blade when pressure is taken off of the blade cover.

10. The apparatus of claim 1, wherein the blade is coupled to the handle.

11. The apparatus of claim 1, wherein the trigger pathway comprises a cavity formed in the trigger, the cavity forming a boundary that guides the pawl into reengagement with the stop after the blade cover has returned from the unlocked operating position.

12. The apparatus of claim 11, wherein the pawl is biased by a spring into engagement with the stop, the spring configured to permit the pawl to pivot relative to the blade cover and travel within the boundary after disengagement with the stop regardless of trigger position.

13. A cutting apparatus comprising:

a handle;

a blade;

a blade cover configured to move between a locked safety position covering the blade and an unlocked operating position where the blade can be uncovered;

a pawl linked to the blade cover, the pawl configured to engage a stop when the blade cover is in the locked safety position;

a trigger extending from the handle and configured, upon actuation, to disengage the pawl from the stop allowing movement of the blade cover to uncover the blade; and the trigger comprising a pathway within which at least a portion of the pawl is caused to travel as a result of the blade cover covering or uncovering the blade, the pathway configured to allow the pawl to return to a locked position when the trigger has not been released;

wherein the pawl remains in the trigger pathway when the blade is uncovered.

14. A utility knife comprising:

a handle;

a blade;

a guard assembly comprising a blade cover, a pawl linked to the blade cover, and a trigger extending from the handle;

the blade cover configured to move between a locked safety position covering the blade and an unlocked operating position where the blade can be uncovered;

the pawl configured to engage a stop when the blade cover is in the locked safety position;

the trigger configured, upon actuation, to disengage the pawl from the stop allowing movement of the blade cover to uncover the blade; and the trigger comprising an opening within which at least a portion of the pawl is caused to travel as a result of the blade cover covering or uncovering the blade, the opening configured to allow the pawl to return to a locked position when the trigger has not been released;

the guard assembly having a ramped step configured to permit the pawl to return to the locked position when the trigger has not been released.

15. The utility knife of claim 14, wherein the opening is a pathway.

16. The utility knife of claim 15, wherein the ramped step is in the pathway.

17. The utility knife of claim 14, wherein the opening is integrally molded in the trigger.

18. The utility knife of claim 14, wherein the pawl pivots on the blade cover.

19. The utility knife of claim 14, wherein the pawl is rigid in at least one direction, such that the blade cover is maintained in the locked safety position when the pawl is engaging the stop.

* * * * *